United States Patent [19]

Maruska

[11] Patent Number: 4,938,138

[45] Date of Patent: Jul. 3, 1990

[54] SAFING AND ARMING MECHANISM WITH CREEP RIBBON ARMING DELAY

[75] Inventor: William O. Maruska, Minnetonka, Minn.

[73] Assignee: Honeywell Inc., Minneapolis, Minn.

[21] Appl. No.: 389,921

[22] Filed: Aug. 7, 1989

[51] Int. Cl.[5] ..... F42C 15/04; F42C 15/26; F42C 15/34

[52] U.S. Cl. ..... 102/235; 102/238; 102/245; 102/255

[58] Field of Search ..... 102/254, 255, 231, 232, 102/233, 235, 237, 238, 244, 245

[56] References Cited

U.S. PATENT DOCUMENTS

| | | | |
|---|---|---|---|
| 2,516,323 | 7/1950 | Jordan | 102/245 |
| 3,603,259 | 9/1971 | Webb | 102/235 |
| 4,653,402 | 3/1987 | Halssig et al. | 102/245 |
| 4,744,298 | 5/1988 | Popovitch | 102/254 |
| 4,770,096 | 9/1988 | Maruska et al. | 102/235 |

*Primary Examiner*—David H. Brown
*Attorney, Agent, or Firm*—R. W. Jensen; E. W. Hughes

[57] ABSTRACT

A spin stabilized projectile (16) containing a high explosive bursting charge (24) is provided with a safing and arming mechanism (20) comprising a safety barrier (48) for blocking the firing train between the detonator (38) and the charge (24), and two mechanical components for restraining and releasing the barrier. The two mechanical components include a conventional setback tab (76), which is responsive to forces of linear acceleration during launching of the projectile (16), and a delayed action lock ball device (67, 68), which is responsive to centrifugal forces after the projectile (16) has begun to spin. The delay in the response of the lock ball device (67, 68) to the centrifugal forces is accomplished by means of a creep ribbon (54) which prevents release of the barrier (48) until the ribbon (54) has undergone a predetermined amount of time-dependent deformation.

20 Claims, 1 Drawing Sheet

SAFING AND ARMING MECHANISM WITH CREEP RIBBON ARMING DELAY

The Government has rights to this invention pursuant to Contract No. F08635-85-C-0151, awarded by the Department of the Air Force.

BACKGROUND OF THE INVENTION

1. Field of the Invention

This invention is in the field of safing and arming devices for spin stabilized projectiles containing high explosive bursting charges.

2. Description of the Prior Art

Explosive projectiles commonly include safing and arming devices which prevent premature firing of the main charge. Generally, a safing and arming device comprises a barrier which blocks the firing train between the detonator and the bursting charge until after the projectile has been launched. Arming of the projectile is accomplished by means of a release mechanism which causes the barrier to move out of the firing train, thereby allowing detonation to occur. In most prior art devices, the release mechanism has comprised mechanical means responsive to either centrifugal force or the force of setback, or both. These mechanical means have generally required a large number of moving parts, making them impractical for use in very small caliber, such as 20–30 mm, projectiles which have limited volumetric capacity. In addition, in many cases, the response time of the release mechanisms is too short, permitting detonation of the projectile too soon after launching. Premature detonation is clearly undesirable since it can cause damage to the platform or airplane from which the projectile is fired, or endanger the launch crew or other friendly troops.

One safing and arming device which was developed in an attempt to overcome some of the aforementioned problems is disclosed in U.S. Pat. No. 4,770,096 ('096) to Maruska et al. In the '096 device, the centrifugal barrier for blocking the firing train is initially held in place by two restraints: a setback tab, which is rendered inoperative by large forces of linear acceleration when the projectile is launched, and a barrier latch, which is bent out of contact with the barrier by a pyrotechnic actuator activated by an arming signal from the projectile's electronic fuzing system after certain predetermined conditions, such as the passage of a predetermined amount of time, have been met.

In the '096 device, the circuitry for producing the arming signal which activates the pyrotechnic actuator for the barrier latch adds to the cost and complexity of the device's electronic fuzing system. Furthermore, the electronic components of the fuzing system and the explosive charge in the pyrotechnic actuator may malfunction in certain thermal and electromagnetic environments. Therefore, there is a need for an improved mechanical alternative to the electronic and pyrotechnic barrier release means used in the '096 device.

SUMMARY OF THE INVENTION

In accordance with the present invention, a spin stabilized projectile containing a high explosive bursting charge is provided with a safing and arming mechanism comprising a safety barrier for blocking the firing train between the detonator and the charge, and two mechanical components for initially restraining and then releasing the barrier after predetermined conditions have been met. The two mechanical components comprise a conventional setback tab, which is responsive to the force of linear acceleration during launching of the projectile, and a delayed action lock ball device, which is responsive to centrifugal force after the projectile has begun to spin. The delay in the response of the lock ball device to the centrifugal force is accomplished by means of a creep ribbon which prevents release of the barrier until the ribbon has undergone a predetermined amount of time-dependent deformation. The purpose of this delay is to allow sufficient time for the projectile to clear the platform from which it was fired so that subsequent detonation of the projectile will not damage the platform or airplane from which it was fired, or endanger the launching crew or other friendly troops.

More specifically, the safing and arming mechanism includes a relatively thin, substantially cylindrical housing having two opposite faces. The housing is positioned in the base of the projectile with the two faces of the housing substantially perpendicular to the spin axis of the projectile. A substantially cylindrical blow-through hole is formed through the housing, with the axis of the blow-through hole coinciding with the spin axis of the projectile. One side of the housing is in communication with the bursting charge of the projectile. An electrically initiated detonator is mounted on the other side of the housing. The function of the detonator is to produce products, gases, flames, and shock waves, when the detonator is detonated by a firing signal produced by the fuzing system. These products cause the bursting charge of the projectile to detonate when the firing train which extends from the detonator to the bursting charge through the blow-through hole in the housing is complete.

Mounted within the safing and arming housing is a cylindrical disk having an opening aligned with the blow-through hole. A barrier cavity, or recess, is formed in the disk, within which a safety barrier is slidably mounted. The barrier has two positions: a safe position, in which the safety barrier blocks the blow-through hole, thereby interrupting the firing train; and an armed position, in which the barrier unblocks the blow-through hole, allowing completion of the firing train.

A central wall separates the barrier cavity from a creep cavity across which a substantially arcuate creep ribbon formed from a deformable material such as lead or polytetrafluoro- ethylene extends. A centrifugal weight is mounted for slidable movement in the creep cavity between the creep ribbon and the central wall. The centrifugal weight is initially held in a central position adjacent the safety barrier by means of a substantially U-shaped clip, the arcuate portion of which is sandwiched between the centrifugal weight and the creep ribbon and is slidable with the centrifugal weight. The legs of the U-shaped clip are disposed for sliding movement in a pair of transverse passageways which extend along opposite sides of the barrier cavity, communicating at one end with the creep cavity and at the opposite end with the outer circumference of the safing and arming housing.

In addition, the transverse passageways communicate with the barrier cavity by means of a pair of inwardly extending lateral passageways, each of which contains a spherical locking ball. Initially, the legs of the U-shaped clip urge the locking balls inwardly, pressing them into mating hemispherical depressions formed on opposite sides of the safety barrier, thus preventing movement of the barrier. A pair of similar depressions is also formed at the distal ends of the legs of the U-shaped clip.

In addition, the housing is provided with a setback member positioned between the barrier and the bottom surface of the safing and arming housing. A setback tab formed in the setback member engages a side of the barrier to maintain the barrier in its safe position until the projectile is fired.

When a projectile which is provided with the safing and arming mechanism of the present invention is fired, the large forces of linear acceleration to which the projectile is subjected will move the setback tab out of contact with the safety barrier, thus effectively removing one of the barrier restraints. In addition, the projectile will be subjected to angular acceleration as it traverses the length of the rifled gun barrel from which it is fired. The resulting high angular velocity will produce a centrifugal force which will tend to cause the centrifugal weight to move in an outward direction in the creep cavity. At first, the creep ribbon will exert an equal and opposite force on the centrifugal weight, preventing such movement from taking place. Eventually, however, the force exerted by the centrifugal weight will cause the ribbon to undergo the time-dependent deformation known as creep. Thus, the ribbon will stretch in an outward direction, allowing the centrifugal weight to move outwardly, pushing the U-shaped clip along with it. When the clip has slid far enough outwardly so that the depressions at the distal ends of the legs of the clip are aligned with the lateral passageways in the safing and arming housing, the centrifugal force will cause the locking balls to move outwardly, away from the barrier, thus removing the second barrier restraint. As a result, the safety barrier responds to the centrifugal force by sliding outwardly in the barrier cavity, unblocking the blow-through hole, and completing the firing train between the detonator and the bursting charge so that detonation can occur.

The length of the delay between the launching of the projectile and the release of the safety barrier is dependent on the rate at which the creep ribbon stretches, which in turn is dependent on the mass of the centrifugal weight, the angular velocity of the projectile, the dimensions of the creep ribbon, and the creep modulus of the material from which the ribbon is made. These parameters are selected so that the creep rate of the ribbon is sufficiently high to allow arming of the projectile before the projectile reaches its target, but sufficiently low to prevent detonation before the projectile has cleared the launching area. Two materials which exhibit appropriate creep rates under typical firing conditions are lead and polytetrafluoroethylene.

It is therefore an object of this invention to provide a spin stabilized projectile with an improved safing and arming mechanism having a safety barrier for blocking the firing train, and independent dual restraints for holding the barrier in place, wherein the restraints are releasable by strictly mechanical means.

Another object of the invention is to provide a safing and arming mechanism with a purely mechanical delay mechanism for controlling the time interval between launching and arming of the projectile.

Still another object of the invention is to provide a low cost safing and arming mechanism which is simple to manufacture and compact enough to fit into a small caliber (20–30 mm) projectile.

The foregoing and other objects of the present invention, as well as the invention itself, may be more fully understood from the following description when read in conjunction with the following drawings.

DESCRIPTION OF THE PREFERRED EMBODIMENT

Figure 1:
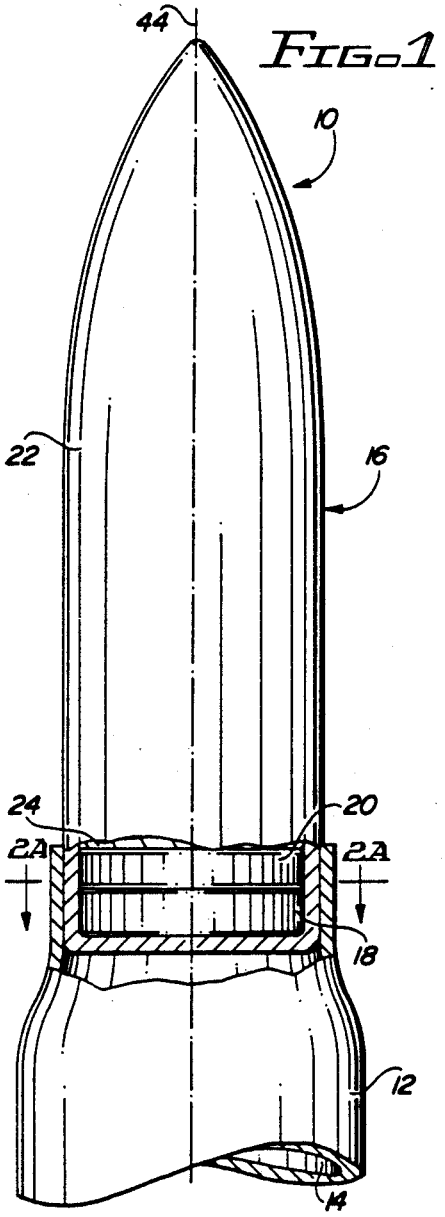
FIG. 1 is a perspective view with parts broken away of a cartridge, the projectile of which is provided is provided with the safing and arming mechanism of this invention.

Referring more particularly to the drawings, FIG. 1 shows a cartridge 10 including a case 12 filled with a suitable low explosive, or propellant, 14. A projectile or shell 16 is secured into the case 12. Located in the base of the projectile 16 is a conventional electronic fuzing system, or fuze 18, which includes a safing and arming mechanism 20. The space within the casing 22 above the safing and arming mechanism 20 is substantially filled with a suitable high explosive bursting charge 24.

The safing and arming mechanism 20 includes a substantially cylindrical housing 26 having an upper face 28 and a lower face 30. A blow-through hole 32 is formed through the upper and lower faces of the housing 26. Mounted within the housing 26 us a cylindrical disk 34 having an opening 36 aligned with the blow-through hole 32. A detonator 38, which is an element of the conventional base fuze 18, is mounted on the lower face 30 of the housing 26 in communication with the blow-through hole 32 and opening 36, and in alignment with the axis 42 of the cylindrical blow-through hole, which is also the axis of the safing and arming housing 26, as is best seen in FIGS. 4A and 4B. The safing and arming device 20 is positioned within the base of the projectile 16 in close proximity to the bursting charge 24, and between the fuze 36 and the bursting charge 24, with the axis 42 of the blow-through hole 32 being substantially aligned with the spin axis and axis of symmetry 44 of the projectile 16.

Figure 2A:
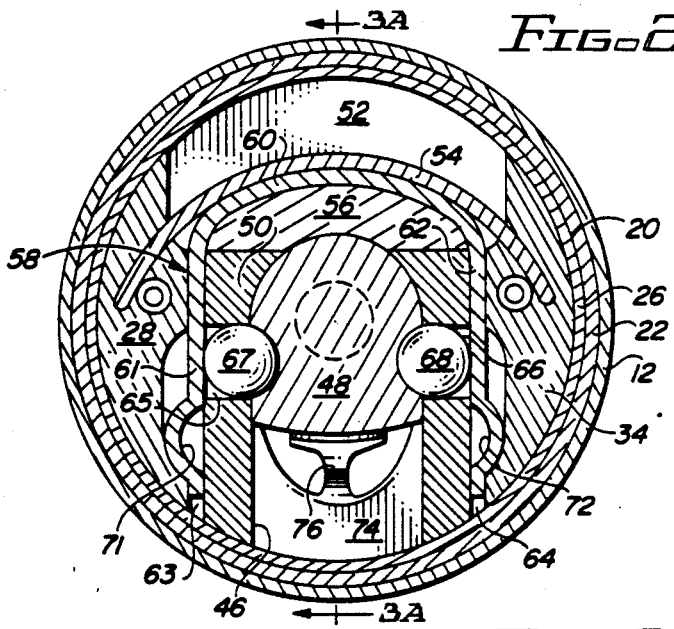
FIG. 2A is an enlarged sectional view taken through line 2A—2A of FIG. 1, showing the safing and arming mechanism with the safety barrier in its safe position.
Figure 2B:
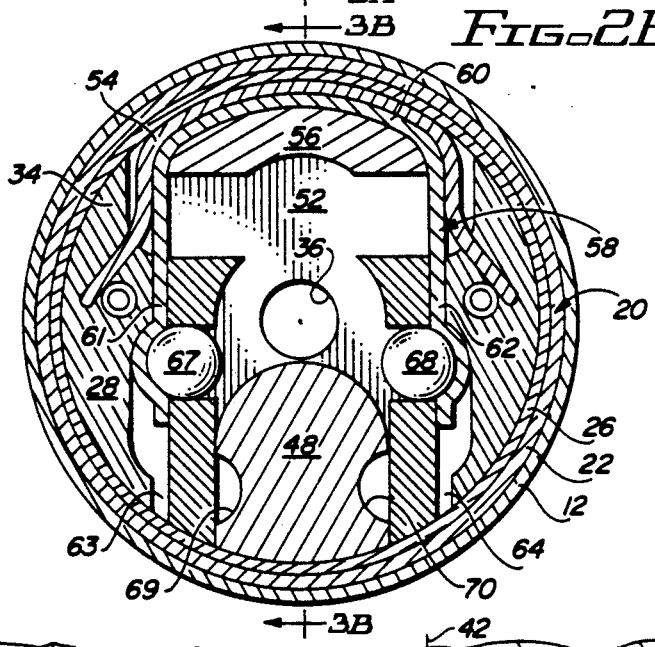
FIG. 2B is an enlarged sectional view similar to FIG. 2A, showing the safing and arming mechanism with the safety barrier in its armed position.
Figure 3A:
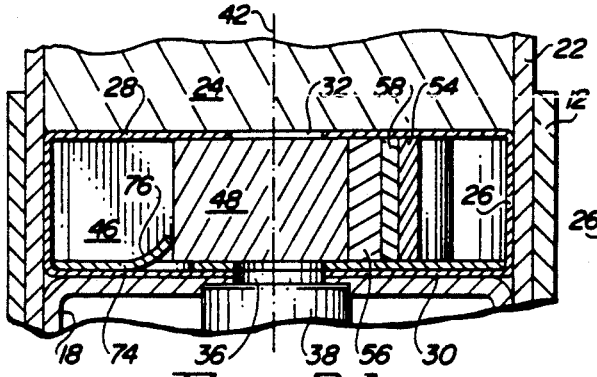
FIG. 3A is a sectional view taken through line 3A—3A of FIG. 2A.
Figure 3B:
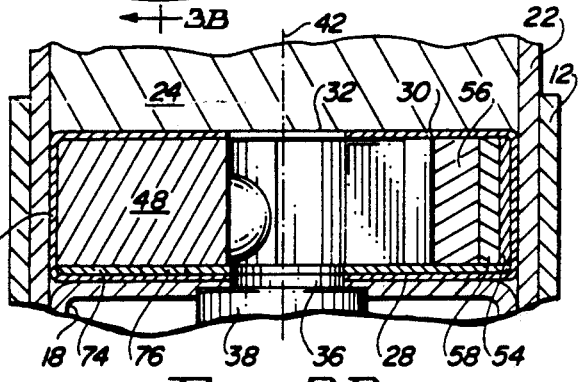
FIG. 3B is a sectional view taken through line 3B—3B of FIG. 2B.

A barrier cavity, or recess, 46 is formed in the cylindrical disk 34, within which a safety barrier 48 is slidably mounted. The barrier 48 has two positions: a safe position, in which the safety barrier 48 blocks the blow-through hole 32 and the opening 36, thereby interrupting the firing train as shown in FIGS. 2A and 3A; and an armed position, in which the barrier 48 unblocks the blow-through hole 32 and the opening 36, allowing completion of the firing train as shown in FIGS. 2B and 3B.

A central divider 50 separates the barrier cavity 46 from a creep cavity 52 across which a substantially arcuate creep ribbon 54 extends. A centrifugal weight 56 is mounted for slidable movement in the creep cavity 52 between the creep ribbon 54 and the central divider 50. The centrifugal weight 56 is initially held in a central position adjacent the safety barrier 48 by means of a substantially U-shaped clip 58, the arcuate portion 60 of which is sandwiched between the centrifugal weight 56 and the creep ribbon 54 and is slidable with the centrifugal weight 56. The legs 61,62 of the U-shaped clip 58 are disposed for sliding movement in a pair of transverse passageways 63, 64 which extend along opposite sides of the barrier cavity 46, communicating at one end with the creep cavity 52 and at the opposite end with the inner circumference of the safing and arming housing 26. In addition, the transverse passageways 63,64 communicate with the barrier cavity 46 by means of a pair of inwardly extending lateral passageways 65,66, each of which contains a spherical locking ball 67, 68. Initially, as is best seen in FIG. 2A, the legs 61,62 of the U-shaped clip 58 urge the locking balls 67, 68 inwardly, pressing them into mating hemispherical depressions 69, 70 formed on opposite sides of the safety barrier 48, thus preventing movement of the barrier 48. A pair of similar depressions 71,72 is also formed at the distal ends of the legs 61,62 of the U-shaped clip 58.

In addition, the safing and arming mechanism 20 is provided with a setback member 74 positioned between the barrier 48 and the bottom surface 30 of the housing 26. A T-shaped setback tab 76 formed in the setback member 74 engages a side of the barrier 48 to maintain the barrier 48 in its safe position until the projectile 16 is fired, as can best be seen in FIG. 3A.

When the projectile 16 is fired from a gun, linear acceleration of the projectile 16 bends the setback tab 76 into substantial alignment with the setback member 74 so that the setback tab 76 no longer opposes, or prevents, the barrier 48 from moving from its safe position to its armed position. As the projectile 16 is accelerated linearly down the barrel of the gun from which it is fired, the projectile 16 is also subjected to angular acceleration about its spin axis 42 so that the projectile 16 has a high angular velocity about its spin axis 42 as it leaves the barrel. The effect of this high angular velocity is to exert a significantly large centrifugal force tending to move the barrier 48 from its safe position to its armed position.

Initially the centrifugal force exerted on the barrier 48 is resisted by the locking balls 67, 68, which are held in place by the legs 61, 62 of the U-shaped clip 58. The clip 58 and the centrifugal weight 56 are also subjected to the same centrifugal force, which tends to move them outwardly, away from the barrier 48. This outward movement is resisted at first by the arcuate creep ribbon 54. Eventually, however, the force exerted by the centrifugal weight 56 will cause the ribbon 54 to undergo the time-dependent deformation known as creep. Thus, the ribbon 54 will stretch in an outward direction, allowing the centrifugal weight 56 to move outwardly, moving the U-shaped clip 58 along with it. When the clip 58 has slid far enough outwardly so that depressions 71,72 at the distal ends of the legs 61,62 of the clip 58 are aligned with the lateral passageways 65,66 in the safing and arming housing 20, the centrifugal force will cause the locking balls 67,68 to move outwardly, away from the barrier 48, so the barrier is no longer restrained. As a result, the safety barrier 48 responds to the centrifugal force by sliding outwardly in the barrier cavity 46, unblocking the blow-through hole 32 and opening 36, as shown in FIGS. 2B and 3B. This completes the firing train between the detonator 34 and the bursting charge 24 so that detonation can occur.

A critical requirement of the present invention is that the creep ribbon 54 be formed from a material which exhibits appropriate creep behavior when subjected to typical firing conditions. It is generally well known that deformation of a material due to creep becomes significant at absolute temperatures which are about half the melting point of the material. Therefore, selected material should have a melting point which is less than or equal to twice the ambient temperature when the projectile is fired. In addition, it is important that the ultimate tensile strength of the material be higher than the maximum load acting on the ribbon 54, since a weaker material could result in premature release of the barrier 48.

Other parameters which influence the behavior of the creep ribbon 54 are the mass of the centrifugal weight 56, the angular velocity of the projectile 16, and the dimensions of the creep ribbon 54. In a typical example, a safing and arming mechanism measuring about ⅜ of an inch (9.25 mm) in diameter in a 20–40 mm round having an angular velocity of 2000 revolutions per second would be provided with a centrifugal weight 56 having a mass of about ⅛ gram. This would result in a centrifugal force of approximately 60,000 G's acting on the centrifugal weight 56, which in turn would exert a force of about 2 lbs (4.448N) on a creep ribbon measuring about 1/10 of an inch (2.54 mm) in thickness. Under these conditions, two materials which would exhibit appropriate creep characteristics are pure lead and polytetrafluoroethylene, which is commonly known under the trade name "Teflon." Both lead and "Teflon" have tensile strengths of approximately 2000 psi (13790 kPa) and melting points of approximately 600K. A creep ribbon 54 formed from either of these materials would deform at a rate sufficient to produce a delay of 10–100 milliseconds between the time the round is fired and the time the barrier 48 unblocks the firing train. A delay of this length ensures that the projectile 16 will be clear of the platform from which it is fired so that subsequent detonation of the projectile 16 will not damage the platform or endanger the launching crew.

It should be obvious that various modifications can be made to the described embodiment without departing from the scope of the present invention.

What is claimed is:

1. A safing and arming mechanism (20) for a spin stabilized projectile (16) containing an explosive charge (24) and a fuzing system (18) including a detonator (38), said safing and arming mechanism (20) comprising:

(a) a safing and arming housing (26) mounted in the base of the projectile (16), said housing (26) having two faces including a first face (28) in communication with said explosive charge (24) and a second face (30) in communication with the fuzing system (36);

(b) a blow-through hole (32) formed through said safing and arming housing (26), said blow-through hole (32) communicating with the detonator (36);

(c) a barrier (48) mounted within said housing, said barrier (48) being movable from a first position, in which said barrier (48) blocks said blow-though hole (32), to a second position in which said barrier (48) does not block said blow-through hole (32);

(d) restraining means (67,68) for preventing movement of said barrier (48) from said first to said second position, said restraining means (67,68) being movable from a restraining position, in which said restraining means (67,68) lock said barrier (48) into said first position above said blow-through hole (32), to a releasing position in which said restraining means (67,68) allow said barrier

(48) to move out of said second position away from said blow-through hole (32); and (e) mechanical delay means (54) for mechanically delaying release of said restraining means (67,68) until a predetermined time period has elasped, said mechanical delay means (54) comprising a creep element which, under typical firing conditions, is deformable from a first state, in which said creep element holds said restraining means (67,68) in said restraining position, to a second state, in which said creep element allows said restraining means (67,68) to move into said release position, wherein deformation of said creep element occurs at a rate determined by the creep characteristics of the material from which said element is formed.

2. The safing and arming mechanism (20) of claim 1, in which the creep characteristics of the material from which said creep element (54) is formed are selected to result in a delay of 10–100 milliseconds between the time the projectile (16) is fired and the time the barrier (48) unblocks the blow-through hole (32).

3. The safing and arming mechanism (20) of claim 1, in which said restraining means comprises:

(a) a pair of hemispherical depressions (69,70) formed on opposite sides of said barrier (48);

(b) a pair of spherical locking balls (67,68) mounted in said safing and arming housing (26) adjacent opposite sides of said barrier (48);

(c) a substantially U-shaped clip (58), said substantially U-shaped clip (58) comprising an arcuate central portion (60) and a pair of legs (61,62), each of said legs (61,61) including a hemisperical depression (71,72) at the distal end thereof, said substantially U-shaped clip (58) partially surrounding said barrier (48) and being movable from a restraining position, in which said legs (61,62) urge said locking balls (67,68) into said hemispherical depressions (69,70) in said barrier (48), to a releasing position in which said hemispherical depressions (71,72) at the distal ends of said legs (61,62) are aligned with said locking balls (67,68), allowing said locking balls (67,68) to roll away from said barrier (48) so that said barrier (48) is free to move into its second position in which said blow-through hole (32) is unblocked; and (d) a centrifugal mass (56) movably mounted in said safing and arming housing (26) between said barrier (48) and said arcuate central portion (60) of said substantially U-shaped clip (58), said centrifugal mass (56) exerting a centrifugal force on said arcuate central portion (60) of said clip (58) when the projectile (16) is subjected to angular velocity.

4. The safing and arming mechanism (20) of claim 3, in which said creep element (54) comprises a substantially arcuate creep ribbon extending across said safing and arming housing (26) and initially opposing the centrifugal force exereted by said centrifugal mass (56) on said arcuate central portion (60) of said substantially U-shaped clip (58) when the projectile (16) is subjected to angular velocity.

5. The safing and arming mechanism (20) of claim 4, in which said creep ribbon (54) is formed from a material having a tensile strength of approximately 2000 psi (13790 kPa).

6. The safing and arming mechanism (20) of claim 4, in which said creep ribbon (54) is formed from a material having a melting point of approximately 600K.

7. A safing and arming mechanism (20) for a spin stabilized projectile (16) containing an explosive charge (24) and having a fuzing system (18), said safing and arming mechanism (20) comprising:

(a) a safing and arming housing (26) mounted in the base of the projectile (16), said housing (26) having two faces including a first face (28) in communication with said explosive charge (24) and a second face (30) opposite said first face (28);

(b) a blow-through hole (32) formed through said safing and arming housing (26);

(c) a detonator (38) mounted on said second face (30) of said housing (26) and in communication with said blow-through hole (32);

(d) a barrier (48) mounted within said housing (26), said barrier (48) being movable from a first position, in which said barrier (48) blocks said blow-through hole (32), to a second position, in which said barrier (48) does not block said blow-through hole (32);

(e) restraining means (67,68,76) for preventing movement of said barrier (48) from said first to said second position, said restraining means (67,68,76) comprising independent dual restraints including (i) a first barrier restraint (74) responsive to linear acceleration of the projectile (16); and (ii) a second barrier restraint (67,68) responsive to angular velocity of the projectile (16), said second barrier restraint (67,68) being movable from a restraining position, in which said restraining means (67,68) lock said barrier (48) into said first position above said blow-through hole (32), to a releasing position in which said restraining means (67,68) allow said barrier (48) to move out of said second position away from said blow-through hole (32); and (f) mechanical delay means (54) for mechnically delaying release of said second barrier restraint (67,68) until a predetermined time period has elapsed, said mechanical delay means (54) comprising a creep element which, under typical firing conditions, is deformable from a first state, in which said creep element holds said second barrier restraint (67,68) in said restraining position, to a second state, in which said creep element allows said second barrier restraint (67,68) to move into said release position, wherein deformation of said creep element occurs at a rate determined by the creep characteristics of the material from which said element is formed.

8. The safing and arming mechanism (20) of claim 7, in which said first barrier restraint comprises a setback member (74) positioned between said barrier (48) and said safing and arming housing (26), said setback member (74) having a setback tab (76), the setback tab (76) having two positions including a first position for holding the barrier (48) in its first position, and second position in which linear forces bend said setback tab (76) into a position in which it does not oppose movement of said barrier (48) from its first to its second position.

9. The safing and arming mechanism (20) of claim 7, in which the creep characteristics of the material from which said creep element (54) is formed are selected to result in a delay of 10–100 milliseconds between the time the projectile (16) is fired and the time the barrier (48) unblocks the blow-through hole (32).

10. The safing and arming mechanism (20) of claim 7, in which said second barrier restraint comprises:

(a) a pair of hemispherical depressions (69,70) formed on opposite sides of said barrier (48);

(b) a pair of spherical locking balls (67,68) mounted in said safing and arming housing (26) adjacent opposite sides of said barrier (48);

(c) a substantially U-shaped clip (58), said substantially U-shaped clip (58) comprising an arcuate central portion (60) and a pair of legs (61,62), each of said legs (61,61) including a hemispherical depression (71,72) at the distal end thereof, said substantially U-shaped clip (58) partially surrounding said barrier (48) and being movable from a restraining position, in which said legs (61,62) urge said locking balls (67,68) into said hemispherical depressions (69,70) in said barier (48), to a releasing position, which said hemispherical depressions (71,72) at the distal ends of said legs (61,62) are aligned with said locking balls (67,68), allowing said locking balls (67,68) to roll away from said barrier (48) so that said barrier (48) is free to move into its second position in which said blow-through hole (32) is unblocked; and (d) a centrifugal mass (56) movably mounted in said safing and arming housing (26) between said barrier (48) and said arcuate central portion (60) of said substantially U-shaped clip (58), said centrifugal mass (56) exerting a centrifugal force on said arcuate central portion (60) of said clip (58) when the projectile (16) rotates about its longitudinal axis at a high angular velocity.

11. The safing and arming mechanism (20) of claim 10, in which said creep element (54) comprises a substantially arcuate creep ribbon extending across said safing and arming housing (26) and initially opposing the centrifugal force exerted by said centrifugal mass (56) on said arcuate central portion (60) of said substantially U-shaped clip (58) when the projectile (16) is subjected to angular acceleration.

12. The safing and arming mechanism (20) of claim 11, in which said creep ribbon (54) is formed from a material having a tensile strength of approximately 2000 psi and a melting point of approximately 600K.

13. The safing and arming mechanism (20) of claim 11, in which said creep ribbon (54) is formed from pure lead.

14. The safing and arming mechanism (20) of claim 12, in which said creep ribbon (54) is formed from polytetrafluoroethylene.

15. A safing and arming mechanism (20) for a spin stabilized projectile (16) containing a high explosive (24) said projectile (16) having a longitudinal axis (44), said safing and arming mechanism (20) comprising:

(a) a safing and arming housing (26) mounted in the base of the projectile (16) substantially perpendicular to the longitudinal axis (44) of the projectile, said housing having two faces (28,30);

(b) a blow-through hole (32) formed through both faces of said housing (26) and substantially aligned with the longitudinal axis (44) of the projectile (16);

(c) a detonator (38) mounted on one face (30) of the housing (26) and in communication with the blow-through hole (32);

(d) a cylindrical disk (34) mounted within said safing and arming housing, said cylindrical disk including an opening (36) aligned with said blow-through hole (32);

(e) a barrier cavity (46) formed in said cylindrical disk (34);

(f) a creep cavity (52) formed in said cylindrical disk (34) adjacent said barrier cavity (46);

(g) a pair of transverse passageways (63,64) extending along opposite sides of said barrier cavity (46); each of said transverse passageways (63,64) communicating at one end with said creep cavity (52) and at the other end with the inner circumference of said safing and arming housing (26);

(h) a pair of inwardly extending lateral passageways (65,66) connecting said transverse passageways (63,64) to said barrier cavity (46);

(i) a barrier (48) movably mounted in said barrier cavity (46), said barrier (48) being movable from a first position, in which said barrier (48) blocks said blow-through hole (32) and said opening (36), to a second position, in which said barrier (48) does not block said blow-through hole (32) and said opening (36);

(j) a setback member (74) positioned between said barrier (48) and said safing and arming housing (26), said setback member (74) having a setback tab (76), the setback tab (76) having two positions including a first position for holding the barrier (48) in the first position, and a second position in which linear forces bend said setback tab (76) into a position in which it does not oppose movement of said barrier (48) from its first to its second position;

(k) a pair of hemispherical depressions (69,70) formed on opposite sides of said barrier (48);

(l) a pair of spherical locking balls (67,68) mounted in said lateral passageways (65,66) adjacent opposite sides of said barrier (48);

(m) a substantially U-shaped clip (58), said substantially U-shaped clip (58) comprising an arcuate central portion (60) slidably mounted in said creep cavity (52) and a pair of legs (61,62) mounted in said transverse passageways (63,64), each of said legs (61,61) including a hemispherical depression (71,72) at the distal end thereof, said substantially U-shaped clip (58) partially surrounding said barrier (48) and being movable from a restraining position, in which said legs (61,62) urge said locking balls (67,68) into said hemispherical depressions (69,70) in said barrier (48), to a releasing position, in which said hemispherical depressions (71,72) at the distal ends of said legs (61,62) are aligned with said locking balls (67,68), allowing said locking balls (67,68) to roll away fron said barrier (48) so that said barrier (48) is free to move into its second position in which said blow-through hole (32) and said opening (34) are unblocked;

(n) a centrifugal mass (56) movably mounted in said creep cavity (52) between said barrier (48) and said arcuate central portion (60) of said substantially U-shaped clip (58), said centrifugal mass (56) exerting a centrifugal force on said arcuate central portion (60) of said clip (58) as a result of angular velocity of the projectile; and (o) a substantially arcuate creep ribbon (54) extending across said creep cavity (52), said creep ribbon (54) being deformable from a first state, in which said creep ribbon (54) opposes the centrifugal force exerted by said centrifugal mass (56) on said arcuate central portion (60) of said substantially U-shaped clip (58) and thereby holds said clip (58) in said restraining position, to a second, elongated state, in which said creep ribbon (54) no longer opposes said centrifugal force, thereby allowing said clip (58) to move into said releasing position, freeing said locking balls (67,68) so that said barrier (48) unblocks saids blow-through hole (32) and allows detonation to occur, wherein deformation of said creep ribbon (54) occurs at a rate determined by the creep characteristics of the material from which said ribbon (54) is formed.

16. The safing and arming mechanism (20) of claim 15, in which the creep characteristics of the material from which said creep element (54) is formed are selected to result in a delay of 10–100 milliseconds between the time the projectile (16) is fired and the time the barrier (48) unblocks the blow-through hole (32).

17. The safing and arming mechanism (20) of claim 15, in which said creep ribbon is formed from a material having a tensile strength of approximately 2000 psi.

18. The safing arming mechanism (20) of claim 17, in which said creep ribbon (54) is formed from polytetrafluoroethylene.

19. The safing and arming mechanism (20) of claim 17, in which said material has a melting point of approximately 600K.

20. The safing and arming mechanism (20) of claim 19, in which said creep ribbon (54) is formed from pure lead.

* * * * *